US008728385B2

(12) United States Patent
Vegge et al.

(10) Patent No.: US 8,728,385 B2
(45) Date of Patent: May 20, 2014

(54) SIDEWALL AND BOTTOM ELECTRODE ARRANGEMENT FOR ELECTRICAL SMELTING REACTORS AND METHOD FOR FEEDING SUCH ELECTRODES

(75) Inventors: Olaf-Trygve Vegge, Kristansand S. (NO); Harald Haaland, Oslo (NO); Jon Brinch, Oslo (NO); Jarle Erland Herstad, Nittedal (NO); Constantin Jorgensen, Oslo (NO)

(73) Assignee: Alcoa Inc., Pittsburgh, PA (US)

( * ) Notice: Subject to any disclaimer, the term of this patent is extended or adjusted under 35 U.S.C. 154(b) by 200 days.

(21) Appl. No.: 13/062,313

(22) PCT Filed: Sep. 16, 2008

(86) PCT No.: PCT/US2008/076550

§ 371 (c)(1), (2), (4) Date: Mar. 4, 2011

(87) PCT Pub. No.: WO2010/033108

PCT Pub. Date: Mar. 25, 2010

(65) Prior Publication Data

US 2011/0156324 A1 Jun. 30, 2011

(51) Int. Cl.
*H05B 7/07* (2006.01)

(52) U.S. Cl.
USPC ..... 266/241; 373/101; 266/44

(58) Field of Classification Search
USPC ..... 266/241, 242, 44; 373/99, 101
See application file for complete search history.

(56) References Cited

U.S. PATENT DOCUMENTS 1,332,795 A * 3/1920 Booth ..... 373/62
2,303,892 A * 12/1942 Moore ..... 373/99

(Continued)

FOREIGN PATENT DOCUMENTS

DE 2125773 12/1972
RU 2235258 8/2004

(Continued)

OTHER PUBLICATIONS

International Search Report and Written Opinion, dated Jun. 22, 2009, from corresponding International Application No. PCT/US2008/076550.

(Continued)

*Primary Examiner* — Scott Kastler
(74) *Attorney, Agent, or Firm* — Greenberg Traurig, LLP

(57) ABSTRACT

Metallurgical reactors having cooling capability and electrode feed capability are disclosed. The reactors may include a shell having a sidewall and a bottom, where the shell is adapted to contain a molten material. The reactors may include at least one consumable electrode protruding through an opening of the shell and into the molten material. The reactors may include a current contact clamp configured to conduct operating current to the electrode, where the current clamp is in contact with the electrode, and where the current clamp comprises at least one internal channel, wherein the internal channel is configured to circulate a cooling medium. The reactors may include an electric isolation ring disposed between the electrode and the opening of the shell, wherein the electric isolation ring is configured to sealingly engage the electrode and the opening so as to restrict flow of the molten material out of the shell.

15 Claims, 3 Drawing Sheets

(56) References Cited

U.S. PATENT DOCUMENTS

| | | | | |
|---|---|---|---|---|
| 3,971,653 | A | 7/1976 | Cochran | 75/10.27 |
| 4,046,558 | A | 9/1977 | Das et al. | 75/416 |
| 4,053,303 | A | 10/1977 | Cochran et al. | 75/10.27 |
| 4,299,619 | A | 11/1981 | Cochran et al. | 75/10.27 |
| 4,394,167 | A | 7/1983 | Kuwahara | 75/674 |
| 4,486,229 | A | 12/1984 | Troup et al. | 75/10.21 |
| 4,491,472 | A | 1/1985 | Stevenson et al. | 75/10.21 |
| 4,526,911 | A | 7/1985 | Boxall et al. | 523/445 |
| 4,544,469 | A | 10/1985 | Boxall et al. | 204/247.3 |
| 4,582,553 | A | 4/1986 | Buchta | 156/242 |
| 4,624,766 | A | 11/1986 | Boxall et al. | 204/294 |
| 4,646,317 | A * | 2/1987 | Evensen | 373/101 |
| 4,663,844 | A | 5/1987 | Vegge | 30/100 |
| 4,678,434 | A | 7/1987 | Dahl et al. | 432/242 |
| 4,724,054 | A | 2/1988 | Brown et al. | 205/373 |
| 4,735,654 | A | 4/1988 | Cochran et al. | 75/589 |
| 4,765,831 | A | 8/1988 | Cochran et al. | 75/605 |
| 4,765,832 | A | 8/1988 | Brown et al. | 75/672 |
| 4,769,067 | A | 9/1988 | Cochran et al. | 75/672 |
| 4,769,068 | A | 9/1988 | Cochran et al. | 75/672 |
| 4,769,069 | A | 9/1988 | Cochran et al. | 75/672 |
| 4,770,696 | A | 9/1988 | Brown et al. | 5/674 |
| 4,812,168 | A | 3/1989 | Cochran et al. | 75/674 |
| 4,977,113 | A | 12/1990 | Phelps et al. | 501/98.1 |
| 6,440,193 | B1 | 8/2002 | Johansen et al. | 75/10.27 |
| 6,475,260 | B2 | 11/2002 | LaCamera | 75/10.27 |
| 6,530,970 | B2 | 3/2003 | Lindstad | 75/10.27 |
| 6,635,198 | B1 | 10/2003 | Vatland et al. | 264/29.1 |
| 6,702,994 | B1 | 3/2004 | Henriksen et al. | 423/337 |
| 6,805,723 | B2 | 10/2004 | Aune et al. | 75/10.27 |
| 6,849,101 | B1 | 2/2005 | Fruehan et al. | 75/10.27 |
| 6,980,580 | B2 | 12/2005 | Aune et al. | 373/61 |
| 7,169,207 | B2 | 1/2007 | Vegge et al. | 75/10.27 |
| 2005/0041719 | A1 | 2/2005 | Aune et al. | |
| 2008/0016984 | A1 | 1/2008 | Christini | 75/10.27 |
| 2008/0196545 | A1 | 8/2008 | Fruehan | 75/10.27 |
| 2009/0013823 | A1 | 1/2009 | Fruehan et al. | 75/243 |
| 2009/0139371 | A1 | 6/2009 | Lepish et al. | 75/10.27 |
| 2010/0147113 | A1 | 6/2010 | Bruno et al. | 75/674 |

FOREIGN PATENT DOCUMENTS

| | | |
|---|---|---|
| RU | 2236659 | 9/2004 |
| WO | WO 2005/022060 | 3/2005 |
| WO | WO 2005/074324 | 8/2005 |
| WO | WO 2010/114525 | 10/2010 |

OTHER PUBLICATIONS

Decision on Grant from corresponding Russian Application No. 2011114978 dated Nov. 16, 2012.

* cited by examiner

SIDEWALL AND BOTTOM ELECTRODE ARRANGEMENT FOR ELECTRICAL SMELTING REACTORS AND METHOD FOR FEEDING SUCH ELECTRODES

CROSS-REFERENCE TO RELATED APPLICATION

This patent application is a §371 national stage patent application based on International Patent Application No. PCT/US2008/076550, filed Sep. 16, 2008, entitled "SIDEWALL AND BOTTOM ELECTRODE ARRANGEMENT FOR ELECTRICAL SMELTING REACTORS AND METHOD FOR FEEDING SUCH ELECTRODES", which is incorporated herein by reference in its entirety.

TECHNICAL FIELD

The present disclosure relates to a sidewall and bottom electrode arrangement for an electrical smelting reactor and to a method for feeding such electrodes.

BACKGROUND

Aluminum metal is generally manufactured by two techniques: the traditional Hall method, where an electric current is passed between two electrodes to reduce alumina to aluminum metal; and the carbothermic method, where aluminum oxide is chemically reduced to aluminum via chemical reaction with carbon. The overall aluminum carbothermic reduction reaction:

$$Al_2O_3+3C \rightarrow 2Al+3CO \quad (1)$$

takes place, or can be made to take place, via a series of chemical reactions, such as:

$$2Al_2O_3+9C \rightarrow Al_4C_3+6CO \text{ (vapor)} \quad (2)$$

$$Al_4C_3+Al_2O_3 \rightarrow 6Al+3CO \text{ (vapor)} \quad (3)$$

$$Al_2O_3+2C \rightarrow Al_2O \text{ (vapor)}+2CO \text{ (vapor)} \quad (4)$$

$$Al_2O_3+4Al \rightarrow 3Al_2O \text{ (vapor)} \quad (5)$$

$$Al \rightarrow Al \text{ (vapor)} \quad (6)$$

Reaction (2), generally known as the slag producing step, often takes place at temperatures between 1875° C. and 2000° C. Reaction (3), generally known as the aluminum producing step, often takes place at temperatures above about 2050° C. Aluminum vapor species may be formed during reactions (2) and (3), although aluminum vapor species may be formed via reactions (4), (5), and (6).

SUMMARY OF THE DISCLOSURE

The instant disclosure relates to improved carbothermic reactors having improved methods, systems and apparatus for feeding electrodes into the reactor.

In some electric smelting reactor processes it is sometimes of advantage or even necessary to use electrodes inserted through the reactor side walls or inserted through the reactor bottom and into molten material, such as liquid slag, metal, alloys or molten salts contained in the reactor. This is for instance the case in the method for production of aluminum by carbothermic reduction of alumina as described in U.S. Pat. No. 6,440,193. In the process described in this patent energy is supplied to a high temperature compartment of the reactor through electrodes inserted through the reactor side walls into a slag layer. In the method disclosed in U.S. Pat. No. 6,440,193 the high temperature compartment has a lower molten slag layer and an upper molten aluminum layer. It is not possible to use vertical electrodes inserted from above in this high temperature compartment as the upper layer of molten aluminum would short circuit the electrodes. Side walls electrodes or bottom electrodes penetrating into the slag layer must therefore be used.

Usually electrodes for electric smelting reactors are consumable carbon electrodes such as graphite or pre-baked carbon electrodes. When consumable electrodes are used, the electrodes must from time to time be fed into the reactor interior in order to compensate for the electrode consumption. The electrodes must penetrate through the reactor sidewall or bottom in a sealed way to prevent liquid material from escaping from the reactor and the electrode seal must also be able to allow feeding of the electrodes without liquid material penetrating through the electrode seal.

Some liquid materials, like slag, are very aggressive and will attack known refractory linings. Reactors operating at high temperatures therefore often have a freeze lining of solid slag for protection of the reactor wall and bottom. Reactors for production of aluminum by carbothermic reduction of alumina are therefore, at least in the area intended to be covered by molten slag, preferably made of cooled metal panels, particularly cooled copper panels, where cooling of the panels is regulated or adjusted in order to provide and maintain a protective layer of frozen slag on the inside of the cooled panels.

It has been found that it is very difficult to insert electrodes through reactor sidewalls and bottoms both for sidewalls and bottoms made from cooled panels and from conventional sidewalls and bottoms made from refractory materials to create and maintain a reliable sealing between the electrode and the cooled panels and to be able to feed the electrodes without the risk for leakage of slag through the electrode opening.

According to one aspect, the present disclosure relates to an electrode arrangement for sidewall and/or electrodes for a metallurgical reactor intended to contain liquid material where at least one consumable electrode is inserted through the sidewall or the bottom of the reactor through an opening in the sidewall or bottom of the reactor, which electrode arrangement is characterized in that it comprises a contact clamp for conducting operating current to the electrode, said current clamp being arranged about the electrode and having internal channels for circulation of a cooling medium and having an inwardly tapered section; an electric isolation ring inserted into the opening in the sidewall or bottom of the reactor and the surface of the electrode to create a sealing between the surface of the electrode and the sidewall or bottom of the reactor; and means for pressing the current clamp against the isolation ring.

According to one embodiment of the present disclosure the front part of the current clamp extends into an opening between the surface of the electrode and the isolation ring.

According to another preferred embodiment the means for pressing the current clamp against the isolation ring comprises a steel ring arranged about the electrode and affixed to the outside of the sidewall or the bottom of the reactor, said steel ring having an outwardly tapered opening and where the current clamp has a correspondingly inwardly tapered outer surface which is pressed into the opening in the steel ring.

According to yet another preferred embodiment the sidewall and/or the bottom of the reactor consist of cooled metal panels where the steel ring is affixed to the cooled metal panel.

The electrode arrangement according to the present disclosure may provide a safe sealing preventing liquid material in the reactor to penetrate through the electrode sealing.

When the sidewall and/or bottom of the reactor consists of cooled metal panels, a layer of frozen layer of the material in the reactor will, during operation of the reactor, form on the cooled panels and this frozen layer of material will extend to the side of the isolation ring facing the interior of the reactor and to the surface of the electrode thus safeguarding the electrode sealing.

The sidewall electrode of the present disclosure can either be horizontal or having an angle to the horizontal. The bottom electrode of the present disclosure is preferably vertical.

The present disclosure further relates to a method for feeding of a consumable electrode arranged in the sidewall and/or bottom of a metallurgical reactor containing liquid material, where the electrode is fed by electrode feeding cylinders connected to the electrode, which method is characterized in that the feeding of the electrode is done based on temperature increase in or close to the sidewall or bottom where the electrode is inserted into the sidewall or bottom of the reactor.

According to a preferred embodiment of the method of the present disclosure where the sidewall and/or the bottom of the reactor is made from cooled metal panels and where a frozen layer of material is formed on the inside of the cooled metal panels, the feeding of the electrode is based on exerting a pressure on the electrode feeding cylinders to break the frozen slag layer when the tip of the electrode has moved towards the sidewall and/or the bottom to such an extent that the frozen material layer has partly melted away.

In one approach, the disclosure may be characterized as a metallurgical reactor comprising:

(i) a shell comprising a sidewall and a bottom, wherein the shell is adapted to contain a molten material, (ii) at least one consumable electrode protruding through an opening of the shell and into the molten material, wherein the opening is located in the sidewall or the bottom of the shell, (ii) a current contact clamp configured to conduct operating current to the electrode, where the current clamp is in contact with the electrode, and wherein the current clamp comprises at least one internal channel, wherein the internal channel is configured to circulate a cooling medium; and (iv) an electric isolation ring disposed between the electrode and the opening of the shell, wherein the electric isolation ring is configured to sealingly engage the electrode and the opening so as to restrict flow of the molten material out of the shell.

In one embodiment, a front part of the current clamp extends into an opening between the surface of the electrode and the isolation ring. In one embodiment, the reactor includes a steel ring arranged about the electrode and affixed to the outside of the sidewall or the bottom of the reactor, where the steel ring has an first mating surface, where the current clamp has a corresponding second mating surface, and where, when the second mating surface of the current clamp engages the first mating surface of the steel ring, that a compressive force is realized on at least the front part of the current clamp. In one embodiment at least one of the sidewall and the bottom of the reactor comprise at least one cooled metal panel. In one embodiment, the steel ring is affixed to at least one cooled metal panel.

DETAILED DESCRIPTION

Figure 1:
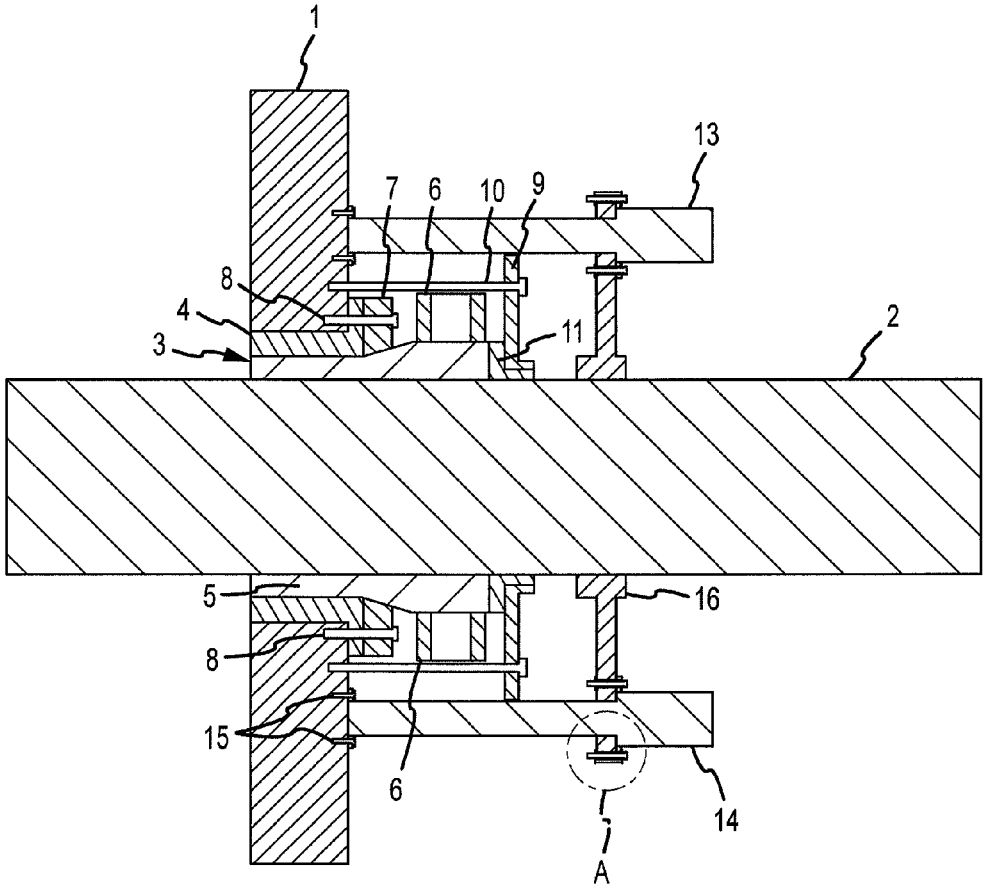
FIG. 1 is a vertical cross section of a first embodiment of an electrode arrangement according to the present disclosure.

On FIG. 1 there is shown a part of a sidewall in a metallurgical reactor intended to contain liquid slag and having a sidewall consisting of cooled copper panels 1. A horizontal consumable electrode 2 is inserted through an opening 3 in the cooled panel 1 and into the interior of the reactor. The reactor is intended to contain liquid slag (e.g., $Al_3C_4$—$Al_2O_3$) and molten metal (e.g., aluminum metal). The electrode 2 is a consumable electrode made from graphite or pre-baked carbon. A sealing and electrical isolation ring 4 is inserted in the opening 3, leaving an annular opening between the electrode 2 and the isolation ring 4. The isolation ring 4 is made from a refractory material that can withstand the temperature, such as, for instance, alumina refractory or any other suitable refractory materials having electric isolating properties.

A current clamp 5 made from copper or a copper alloy and having internal channels for circulation of a cooling medium is arranged about the electrode 2. The current clamp 5 has an inwardly tapered part and is pressed into the opening 3 between the electrode 2 and the isolation ring 4 to seal the sidewall from leaking the molten material intended to be contained in the reactor.

Current conductors 6 for conducting operating current to the electrode 2 from a current source (not shown) are connected to the current clamp 5. The current conductors 6 are in the form of pipes for supply of cooling medium to the current clamp 5.

The current clamp 5 is pressed into the opening 3 between the isolation ring 4 and the electrode 2 in the following way: A steel ring 7 having an outwardly tapered inner surface is affixed to the panel 1 by means of bolts 8. The bolts are isolated from the panel 1. The current clamp 5 is forced against the electrode 2 and the steel ring 7 by means of a second steel ring 9 affixed to the panel 1 by means of bolts 10. An electric isolation ring ills inserted between the current clamp 5 and the second steel ring 9. By tightening the bolts 10, the current clamp 5 is pressed against the electrode 2 and the steel ring 7 with a sufficient amount of preset sealing force to seal the sidewall, and to provide sufficient electrical contact pressure between the electrode 2 and the current clamp 5.

In order to feed the consumable electrode 2, electrode feeding cylinders 13, 14 are affixed to the panel 1 by means of bolts 15 or the like. The electrode feeding cylinders 13, 14 are connected to the electrode 2 by means of an electrode clamping ring 16, which can be clamped against an outer surface of the electrode 2. The electrode clamping ring 16 can be a conventional hydraulic cylinder or a spring packet. The electrode clamping ring 16 is affixed to the electrode feeding cylinders 13, 14 by means of bolt and nut connections.

Figure 2:
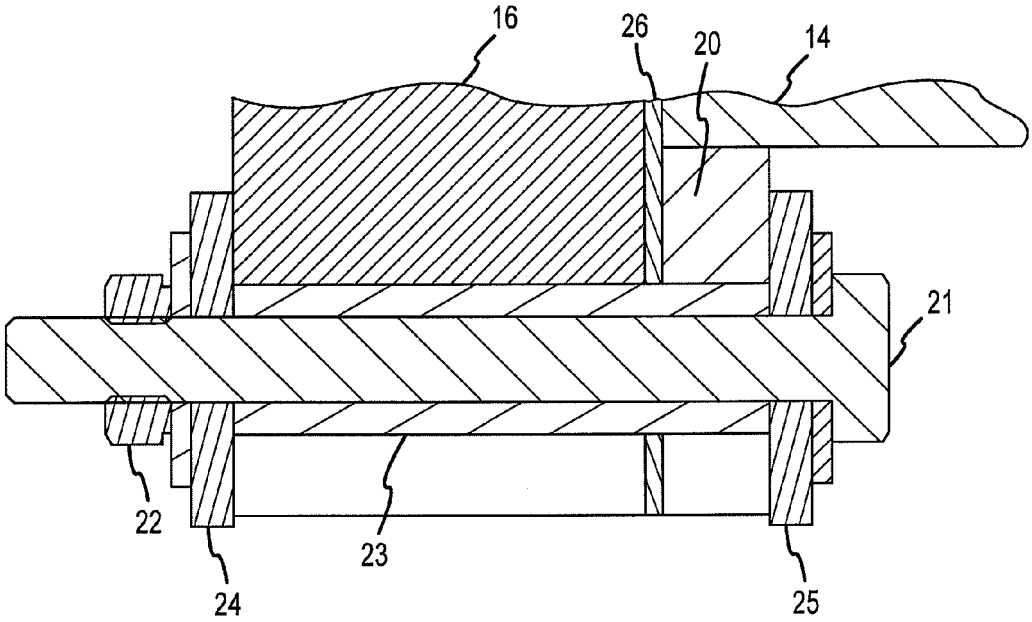
FIG. 2 shows an enlarged view of area A from FIG. 1.

More particularly, and with reference now to FIG. 2, an outer flange 20 on the electrode feeding cylinder 14 is affixed to the outer part of the electrode clamping ring 16 by means of a bolt 21 and nut 22 connection. In order to isolate the electrode clamping 16 from the electrode feeding cylinder 14, an isolation sleeve 23 is inserted into the boring for the bolt 21 together with isolation members 24 and 25. Finally an isolation ring 26 is arranged between the electrode feeding cylinder 14 and the electrode clamping ring 16. Similar arrangements may be utilized for the other connecting bolts (e.g., any of bolts 8, 10 or 15). Other bolt connection arrangements may be utilized.

Figure 3:
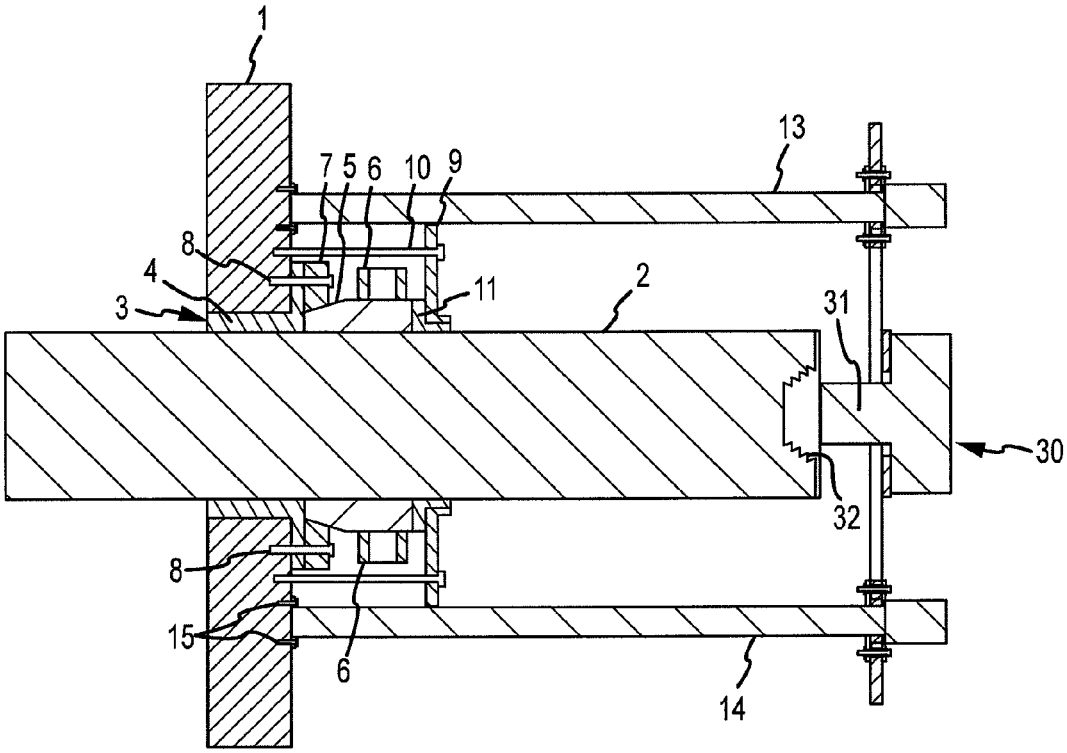
FIG. 3 is a vertical cross section of a second embodiment of an electrode arrangement according to the present disclosure.

In FIG. 3 there is shown a second embodiment of an electrode of the present disclosure. Parts on FIG. 3 corresponding to parts on FIG. 1 have identical reference numbers. The embodiment shown in FIG. 3 differs from the embodiment shown in FIG. 1 in two aspects.

First, the current clamp 5 does not extend into the opening 3 in the copper panel 1. In the embodiment shown in FIG. 3 the sealing between the electrode and the panel 1 consists of the isolation ring 4 with the current clamp 5 pressing against the steel ring 7 and the isolation ring 4. This embodiment for electrode sealing may be a simpler implementation than the embodiment shown in FIG. 1.

Secondly, the electrode feeding cylinders 13, 14 are connected to a device 30, which is adapted to push the rear of the electrode into the reactor. The device 30 includes a nipple 31 having threads 32 screwed into a threaded recess in the back end of the electrode 2. The nipple 31 shown in FIG. 3 is conical, but can also be of cylindrical shape. When the electrode feeding cylinders 13, 14 are actuated, the device 30 is actuated and presses on the rear of the electrode, thereby moving a portion of the electrode tip further into the reactor.

Even though the present disclosure has been described in connection with reactor sidewall consisting of cooled metal panels, the same will apply to reactor sidewalls and bottoms with conventional refractory linings.

In operation of the described reactor, there will be created, due to the cooling of the panels 1, a frozen slag layer on the interior side of the cooled panels 1 (i.e., the side of the panels facing the interior of the reactor). This frozen slag layer will, for the embodiment shown in FIG. 1 extend across the isolation ring 4, the inner end of the current clamp 5 and to the electrode 2 and at least partially assist in the sealing between the electrode 2 and the copper cooled panels 1. For the embodiment shown in FIG. 3 the frozen slag layer will extend across the isolation ring and to the electrode 2, and likewise at least partially assist in the sealing between the electrode 2 and the cooled panels 1.

The electrode 2 is consumed during operation of the reactor and the electrode tip 12 will slowly move towards the reactor sidewall. Therefore the electrode 2 is fed into the reactor from time to time as the electrode tip 12 moves closer to the cooled panel 1. Since the temperature at the electrode tip 12 is at a high temperature, the temperature close to the electrode sealing will increase. In some embodiments, the heat at the electrode tip 12 of the electrode may partly melt away the frozen slag layer proximal the electrode 2. In one embodiment, the feeding of the electrode 2 is based on this temperature increase. In a related embodiment, the feeding of the electrode 2 is completed by exerting a pressure on the electrode feeding cylinders 13, 14 that will be sufficient to break the remaining frozen layer of slag whereby the electrode 2 is fed into the reactor (e.g., at a predetermined length). After having fed the electrode, the pressure on the electrode clamping ring 16 is released, and the electrode feeding cylinders 13,14 and the electrode clamping ring 16 are retracted and pressurized and ready for the next feeding cycle of the electrode 2. Since the electrode tip 12 through the feeding of the electrode has been moved further away from the reactor wall, a new layer of frozen slag will be reestablished between the surface of the electrode 2 and the cooled panels 1. In this way a safe feeding of the electrode 2 can be performed without leakage of molten slag.

What is claimed is:

1. A metallurgical reactor comprising:

a shell comprising a sidewall and a bottom, wherein the shell is configured to contain a molten material;

at least one consumable electrode fed through an opening of the shell and into the molten material, wherein the consumable electrode is configured to provide an operating current to the molten material, and wherein the opening is located in the sidewall or the bottom of the shell;

a current clamp configured to conduct the operating current to the electrode; wherein the current clamp is in contact with the electrode as the electrode is fed; and wherein the current clamp comprises at least one internal channel configured to circulate a cooling medium;

an electric isolation ring disposed between the electrode and the opening, wherein the electric isolation ring is configured to electrically isolate the sidewall or the bottom;

a first ring surrounding the electrode and connected to the sidewall or the bottom configured to press the current clamp against the electrode; and a second ring surrounding the electrode and connected to the sidewall or the bottom configured to press the current clamp against the sidewall or the bottom, wherein a front part of the current clamp extends into an opening between the surface of the electrode and the isolation ring.

2. A reactor according to claim 1, wherein at least one of the sidewall and the bottom of the reactor comprise at least one cooled metal panel.

3. A reactor according to claim 2, wherein the first ring is affixed to at least one cooled metal panel.

4. A metallurgical reactor, comprising:

a reactor configured to contain a molten material, wherein the reactor comprises a sidewall and a bottom, and wherein the sidewall defines at least one sidewall opening;

an electrode disposed through the sidewall opening configured to contact the molten material and to provide an operating current to the molten material;

a first isolation layer disposed between an inner surface of the sidewall opening and the electrode configured to electrically isolate the sidewall;

a current clamp disposed about the electrode configured to contact the electrode and to provide the operating current to the electrode;

a first adjustable ring surrounding the electrode and connected to the sidewall configured to press the current clamp against the electrode; and a second adjustable ring surrounding the electrode and connected to the sidewall configured to press the current clamp against the sidewall, wherein the first and second adjustable rings are configured to seal the sidewall opening against leakage of molten material as the first adjustable ring presses the current clamp against the electrode and the second adjustable ring presses the current clamp against the sidewall.

5. The metallurgical reactor of claim 4, wherein the current clamp and the first adjustable ring are correspondingly tapered to seal the sidewall opening against leakage of molten material and the first adjustable ring is tapered to press the current clamp against the electrode as the second adjustable ring presses the current clamp against the sidewall.

6. The metallurgical reactor of claim 5, further comprising a second isolation layer disposed between the second adjustable ring and the electrode, wherein the second isolation layer is configured to electrically isolate the sidewall.

7. The metallurgical reactor of claim 6, wherein the current clamp is disposed adjacent the second isolation layer and the second isolation layer is disposed between the current claim and the second isolation layer to electrically isolate the second adjustable ring from the current clamp.

8. The metallurgical reactor of claim 7, further comprising a bolt to connect the first adjustable ring to the sidewall, wherein the first isolation ring is configured to extend around an outer surface of the sidewall opening and wherein the bolt connects to the sidewall through the first isolation ring to electrically isolate the sidewall.

9. The metallurgical reactor of claim 8, further comprising a frozen ledge formed from the molten material to the seal of the sidewall opening, wherein an amount of frozen ledge surrounding the sidewall opening corresponds to at least one of a distance of a tip of the electrode within the molten material and away from the sidewall and a temperature of the electrode adjacent to the frozen ledge surrounding the sidewall opening, and wherein an electrode feeding rate into the molten material corresponds to at least one of the distance of the tip and the temperature of the electrode adjacent to the frozen ledge.

10. The metallurgical reactor of claim 9, further comprising an electrically isolated electrode feeding cylinder disposed about the electrode and connected to the sidewall to feed the electrode through the sidewall opening and into the molten material.

11. The metallurgical reactor of claim 10, wherein the current clamp is disposed adjacent to the first isolation layer and on an exterior side of the sidewall.

12. The metallurgical reactor of claim 10, wherein at least part of the current clamp is disposed within the sidewall opening and the current clamp is disposed between the first isolation layer and the electrode.

13. The metallurgical reactor of claim 12, wherein the current clamp is in electrical contact with the electrode as the electrode is fed into the molten material.

14. A method of providing an operating current to a metallurgical reactor, comprising:

providing a sidewall opening in the reactor, wherein the reactor is configured to hold a molten material, feeding an electrode through the sidewall opening, wherein the electrode is configured to provide an operating current to the molten material; and contacting a current clamp to the electrode, wherein the current clamp is configured to provide the operating current to the electrode, wherein the current clamp is in electrical contact with the electrode as the electrode is fed into the molten material, and wherein the metallurgical reactor comprises the metallurgical reactor of claim 4.

15. A method of providing an operating current to a metallurgical reactor, comprising:

providing a sidewall opening in the reactor, wherein the reactor is configured to hold a molten material;

feed in an electrode through the sidewall opening, wherein the electrode is configured provide an operating current to the molten material; and contacting a current clamp to the electrode, wherein the current clamp is configured to provide the operating current to the electrode, wherein the current clamp is in electrical contact with the electrode as the electrode is fed into the molten material, and wherein the metallurgical reactor comprises the metallurgical reactor of claim 12.

* * * * *